US010337208B2

(12) United States Patent
Chen

(10) Patent No.: US 10,337,208 B2
(45) Date of Patent: Jul. 2, 2019

(54) LOCK DEVICE

(71) Applicant: Yee-Chee Chen, Singapore (SG)

(72) Inventor: Yen-Po Chen, Taipei (TW)

(73) Assignee: Yee-Chee Chen, Singapore (SG)

( * ) Notice: Subject to any disclaimer, the term of this patent is extended or adjusted under 35 U.S.C. 154(b) by 0 days.

(21) Appl. No.: 15/900,304

(22) Filed: Feb. 20, 2018

(65) Prior Publication Data

US 2019/0112837 A1 Apr. 18, 2019

(30) Foreign Application Priority Data

Oct. 13, 2017 (TW) ..... 106135032 A

(51) Int. Cl.
*E05B 19/00* (2006.01)
*E05B 27/00* (2006.01)
*E05B 35/06* (2006.01)

(52) U.S. Cl.
CPC ..... *E05B 27/0057* (2013.01); *E05B 19/0017* (2013.01); *E05B 19/0047* (2013.01); *E05B 27/00* (2013.01); *E05B 27/0014* (2013.01); *E05B 27/0021* (2013.01); *E05B 27/0078* (2013.01); *E05B 35/06* (2013.01)

(58) Field of Classification Search
CPC ..... E05B 19/007; E05B 19/0076; E05B 19/0017; E05B 19/0023; E05B 19/0029; E05B 19/0035; E05B 19/0041; E05B 19/0047; E05B 27/00; E05B 27/0057; E05B 29/00; E05B 29/0033; E05B 29/0053; E05B 35/06
See application file for complete search history.

(56) References Cited

U.S. PATENT DOCUMENTS 424,412 A * 3/1890 Fischer ..... E05B 35/06 70/407
616,751 A * 12/1898 Vedder et al. ..... E05B 35/06 70/493
1,932,706 A * 10/1933 Neer ..... E05B 35/06 70/372
4,454,735 A * 6/1984 Huang ..... E05B 35/06 70/346

(Continued)

FOREIGN PATENT DOCUMENTS

GB 2214555 A 9/1989

OTHER PUBLICATIONS

Search Report issued to European counterpart application No. 18161823.2 by the EPO dated Sep. 27, 2018 (9 pages).

*Primary Examiner* — Christopher J Boswell
(74) *Attorney, Agent, or Firm* — Hamre, Schumann, Mueller & Larson, P.C.

(57) ABSTRACT

A lock includes a housing, a cylindrical core body and a tumbler unit. The core body is rotatably mounted in the housing, and includes a core axle, and a core tube sleeved on the core axle. The core axle has a helical keyway. The tumbler unit includes a housing pin hole formed in the housing, a tube through hole formed through the core tube, a pin assembly movably mounted in the housing pin hole and the tube through hole, a hole-defining surface defining the tube through hole and having a shoulder surface portion, and a resilient member disposed in the housing and resiliently biasing the pin assembly to abut against the shoulder surface portion and extend into the helical keyway.

6 Claims, 8 Drawing Sheets

(56) References Cited

U.S. PATENT DOCUMENTS

| | | | | |
|---|---|---|---|---|
| 4,512,166 | A * | 4/1985 | Dunphy | E05B 21/06 70/366 |
| 6,925,844 | B2 * | 8/2005 | Liu | E05B 35/06 70/358 |
| 9,200,474 | B1 * | 12/2015 | Chen | E05B 27/0057 |
| 9,435,140 | B2 * | 9/2016 | Chen | E05B 27/0057 |
| 2004/0172992 | A1 * | 9/2004 | Huang | E05B 35/06 70/358 |
| 2015/0330103 | A1 | 11/2015 | Chen | |

* cited by examiner

LOCK DEVICE

CROSS-REFERENCE TO RELATED APPLICATION

This application claims priority of Taiwanese Patent Application No. 106135032, filed on Oct. 13, 2017.

FIELD

The disclosure relates to a lock device, and more particularly to a lock and a key.

BACKGROUND

A conventional lock device includes a lock and a key. The lock includes a core body and a plurality of pins. The core body extends along a central axis, and has a plurality of helical keyways and a plurality of through holes. Each of the helical keyways is formed in an outer surrounding surface of the core body, and extends about the central axis. Each of the through holes is formed in the outer surrounding surface of the core body, extends through the central axis, and is in spatial communication with a respective one of the helical keyways. The pins are respectively and movably mounted in the through holes, and respectively extend into the helical keyways. The key has a plurality of helical blades that respectively correspond to the helical keyways. Each of the helical blades has a recess that is formed in an inner helical surface thereof. When the helical blades are respectively inserted into the helical keyways, each of the pins has an end engaging the recess of the corresponding one of the helical blades and an opposite end flush with the outer surrounding surface of the core body.

However, since each of the through holes extends through the central axis of the core body, the core body must be made of a relatively high-strength material for maintaining a sufficient structural strength thereof. Moreover, it may be difficult to form the recess in the inner helical surface of each of the helical blades.

SUMMARY

Therefore, an object of the disclosure is to provide a lock that can alleviate at least one of the drawbacks of the prior art.

According to the disclosure, the lock includes a housing, a cylindrical core body and at least one tumbler unit. The housing has an inner surrounding surface that defines an inner space. The core body has a lock axis. The core body is substantially mounted in the inner space, and is rotatable relative to the housing about the lock axis. The core body includes a core axle that extends along the lock axis, and a core tube that is sleeved on the core axle. The core axle has at least one helical keyway that is formed in an outer surrounding surface thereof and that extends about the lock axis. The helical keyway extends through an end surface of the core axle to form an insertion opening. The tumbler unit includes a housing pin hole that is formed in the inner surrounding surface of the housing, a tube through hole that is formed through the core tube and that is in spatial communication with the helical keyway, a pin assembly that is movably mounted in the housing pin hole and the tube through hole, a hole-defining surface that defines the tube through hole, and a resilient member that is disposed in the housing and that resiliently biases the pin assembly toward the lock axis. The hole-defining surface has a shoulder surface portion that faces away from the core axle. When the core body is at a latching position relative to the housing where the housing pin hole and the tube through hole of the tumbler unit are aligned with each other, the resilient member resiliently biases the pin assembly to abut against the shoulder surface portion and extend into the helical keyway through the inner surrounding surface of the housing.

Another object of the disclosure is to provide a key that can alleviate at least one of the drawbacks of the prior art.

According to the disclosure, the key is for use with a lock, and includes a grip section and a blade section. The grip section is for being held. The blade section is connected to the grip section. The blade section includes at least one helical blade that extends about a key axis of the key. The helical blade corresponds in shape to a helical keyway of the lock, and has at least one recess that is formed in an outer helical surface thereof. The recess of the helical blade is engaged with a pin assembly of the lock when the helical blade is inserted into the helical keyway of the lock.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
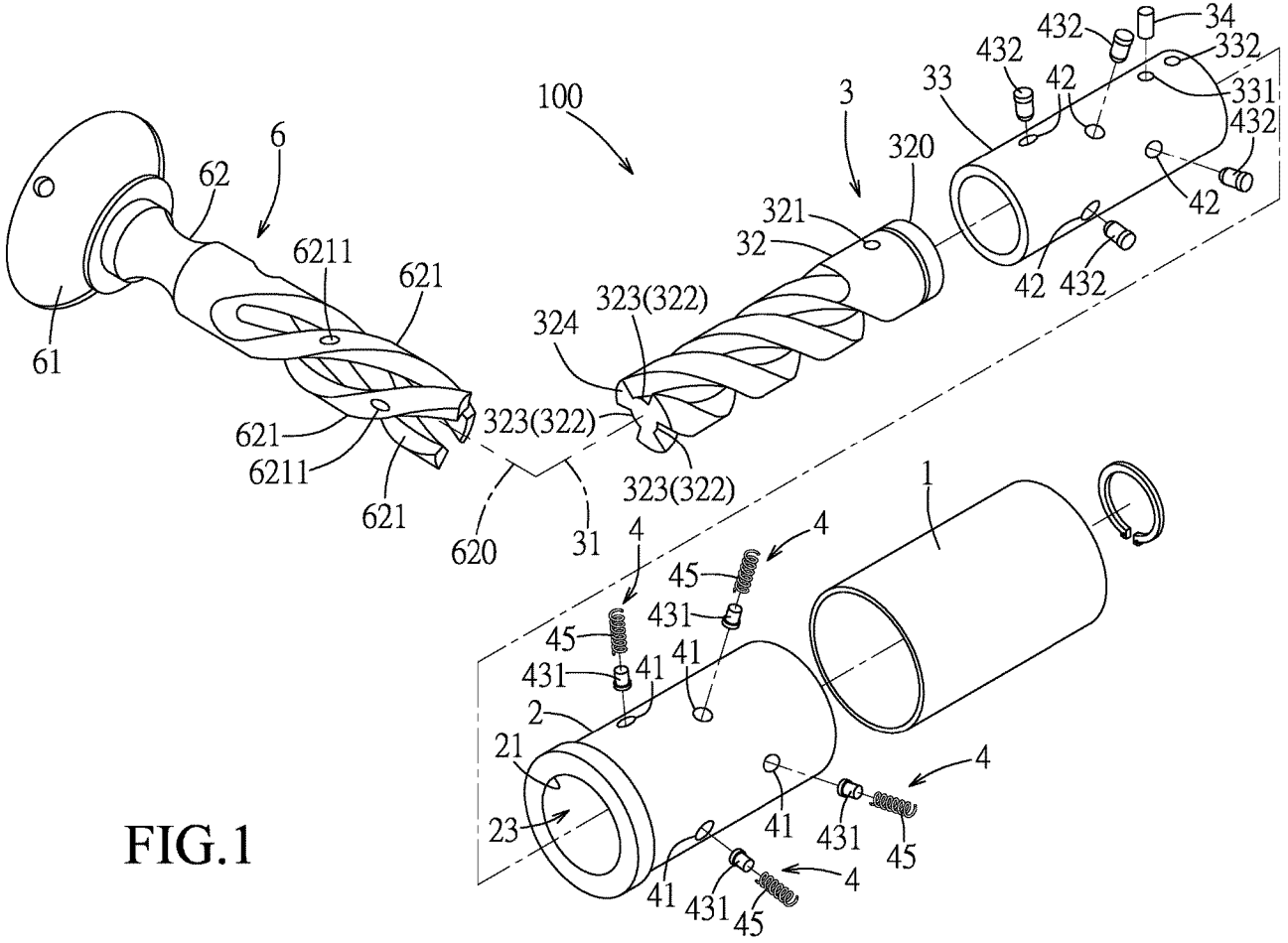
FIG. 1 is an exploded perspective view illustrating a first embodiment of a lock device according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIG. 1, the first embodiment of the lock device according to the disclosure includes a lock 100 and a key 6. The lock 100 includes a sleeve 1, a housing 2, a core body 3, a plurality of tumbler units 4 and a positioning module 5 (see FIG. 2).

The sleeve 1 is sleeved on the housing 2. The housing 2 has an inner surrounding surface 21 that defines an inner space 23.

The core body 3 is cylindrical, and has a lock axis 31. The core body 3 is substantially mounted in the inner space 23, and is rotatable relative to the housing 2 about the lock axis 31. In this embodiment, the core body 3 includes a core axle 32 that extends along the lock axis 31, a core tube 33 that is sleeved on the core axle 32, and a connecting pin 34. The core tube 33 has a through hole 331 that is formed through inner and outer surrounding surfaces thereof, and a positioning groove 332 that is formed in the outer surrounding surface thereof. The core axle 32 has a connecting hole 321 that is formed in an outer surrounding surface thereof, three angularly spaced-apart helical keyways 323 each of which is formed in the outer surrounding surface of the core axle 32 and extends about the lock axis 31, and a mount head 320.

Figure 2A:
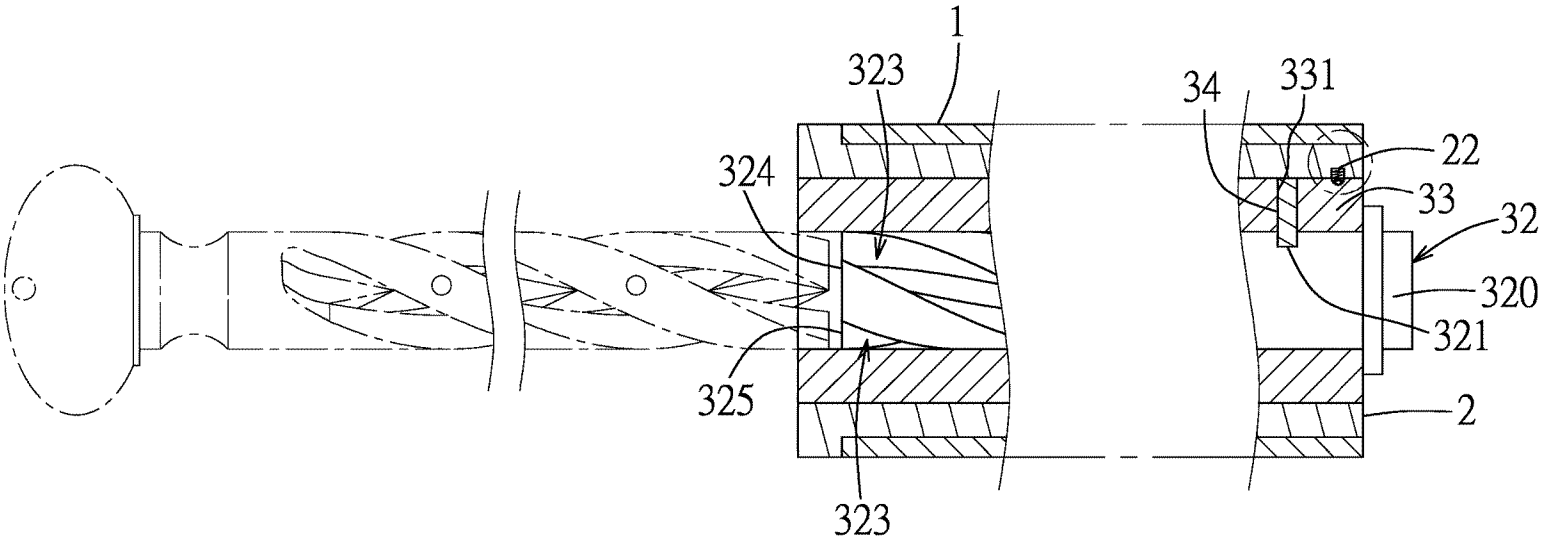
FIG. 2A is a fragmentary sectional view illustrating a lock of the first embodiment.
Figure 2B:
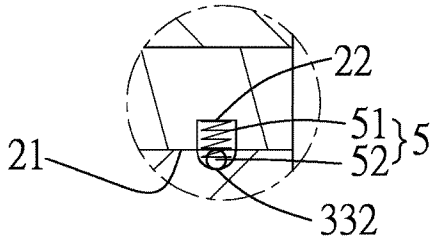
FIG. 2B is an enlarged view of the circled region in FIG. 2A.

Referring to FIG. 2, the connecting pin 34 is inserted into the through hole 331 of the core tube 33 and the connecting hole 321 of the core axle 32 so that the core axle 32 and the core tube 33 are co-rotatable with each other. The housing 2 further has a retaining groove 22 that is formed in the inner surrounding surface 21. The positioning module 5 includes a compression spring 51 that is received in the retaining groove 22, and a positioning member 52 that is connected to an end of the compression spring 51 proximate to the lock axis 31. The mount head 320 extends out of the housing 2 for being mounted with a latch piece (not shown).

Figure 3:
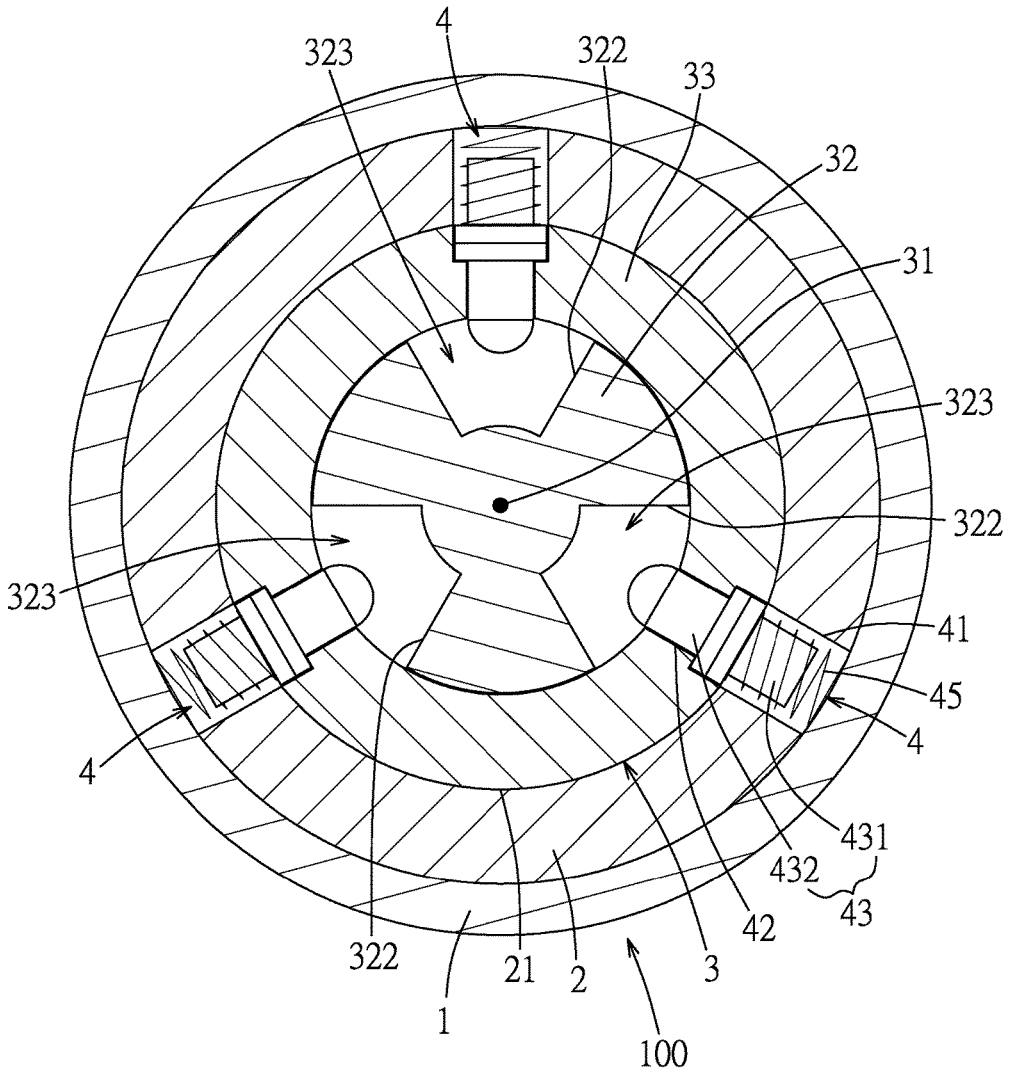
FIG. 3 is a sectional view illustrating the lock.

Referring to FIG. 3, the helical keyways 323 are respectively defined by three keyway-defining surfaces 322 of the core axle 32. Each of the helical keyways 323 extends through an end surface 324 of the core axle 32 distal from the mount head 320 to form an insertion opening 325 (see FIG. 2).

Figure 4:
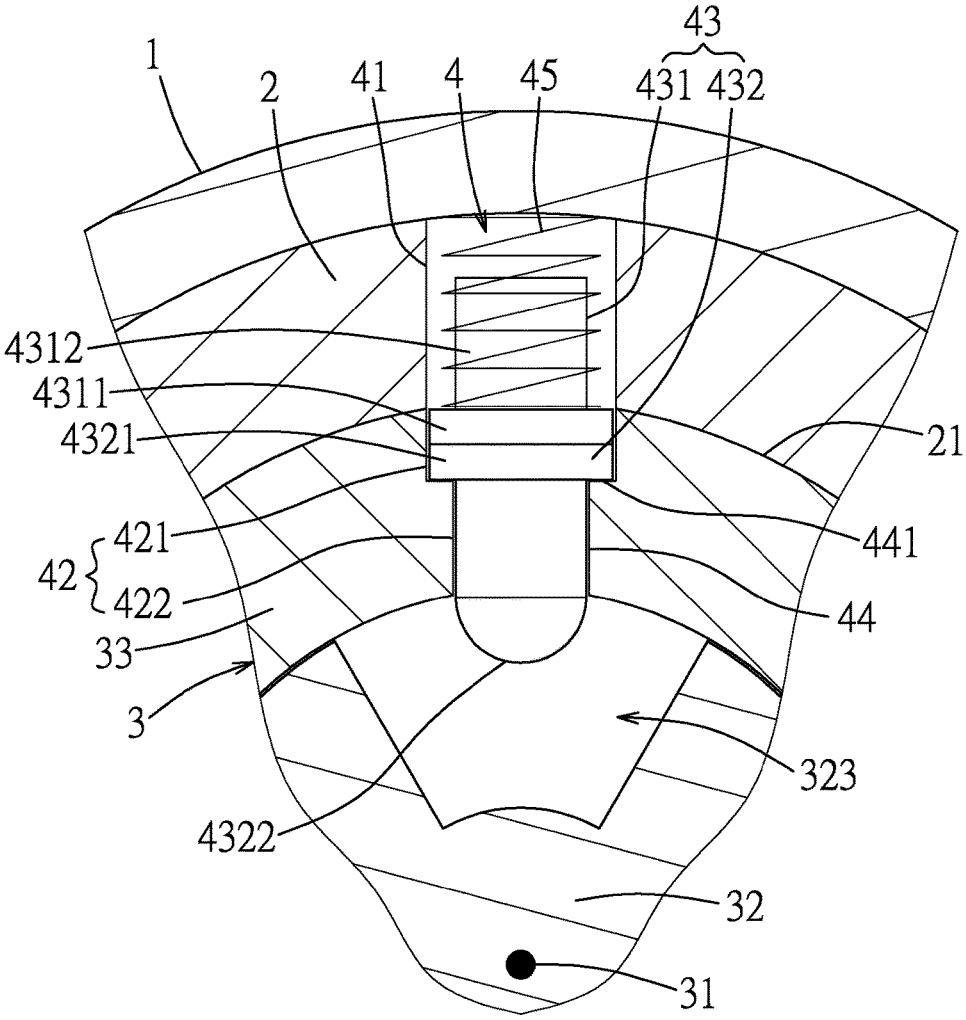
FIG. 4 is a fragmentary sectional view illustrating a pin assembly of the lock at a locking position.

Referring to FIG. 4, each of the tumbler units 4 includes a housing pin hole 41 that is formed in the inner surrounding surface 21 of the housing 2, a tube through hole 42 that is formed through the core tube 33 and that is in spatial communication with one of the helical keyways 323, a pin assembly 43 that is movably mounted in the housing pin hole 41 and the tube through hole 42, a hole-defining surface 44 that defines the tube through hole 42, and a resilient member 45 that is disposed in the housing 2 and that resiliently biases the pin assembly 43 toward the lock axis 31. In one embodiment, the housing pin hole 41 is formed through the housing 2.

For the sake of brevity, only one tumbler unit 4 is described in the following paragraphs.

The tube through hole 42 has a large-diameter section 421 that is distal from the core axle 32, and a small-diameter section 422 that is proximate to the core axle 32 and that has a diameter smaller than that of the large-diameter section 421. The hole-defining surface 44 has a shoulder surface portion 441 that is formed between the large-diameter section 421 and the small-diameter section 422 and that faces away from the core axle 32.

The pin assembly 43 includes a first pin 431 that is movably mounted in the housing pin hole 41, and a second pin 432 that is movably mounted in the tube through hole 42. In this embodiment, the first pin 431 has a large-diameter section 4311, and a small-diameter section 4312 that has a diameter smaller than that of the large-diameter section 4311. The resilient member 45 is configured as a compression spring that surrounds the small-diameter section 4312 of the first pin 431 and that has two opposite ends respectively abutting against an inner surface of the sleeve 1 and the large-diameter section 4311 of the first pin 431. The second pin 432 has a large-diameter section 4321 that is movably received in the large-diameter section 421 of the tube through hole 42, and a small-diameter section 4322 that has a diameter smaller than that of the large-diameter section 4321 and that extends through the small-diameter section 422 of the tube through hole 42. When the core body 3 is at a latching position relative to the housing 2 (see FIG. 3), the housing pin hole 41 and the tube through hole 42 of the tumbler unit 4 are aligned with each other, and the pin assembly 43 is movable between a locking position (see FIG. 4) and an unlocking position (see FIG. 5).

Referring back to FIG. 1, the key 6 extends along a key axis 620, and has a grip section 61 for being held, and a blade section 62 connected to the grip section 61. The blade section 62 includes a plurality of helical blades 621 each of which corresponds in shape to a respective one of the helical keyways 323 and extends about the key axis 620. Each of the helical blades 621 has at least one recess 6211 that is formed in an outer helical surface thereof.

Referring to FIG. 4, when the core body 3 is at the latching position relative to the housing 2 and when the key 6 is not inserted into the lock 100, the pin assembly 43 is maintained at the locking position by the resilient member 45. At this time, the first pin 431 prevents the relative movement between the housing 2 and the core body 3, the large-diameter section 4321 of the second pin 432 abuts against the shoulder surface 441 so as to be prevented from moving into the corresponding helical keyway 323, and the small-diameter section 4322 of the second pin 432 extends into the corresponding helical keyway 323 through the inner surrounding surface 21 of the housing 2. In this embodiment, when the pin assembly 43 is at the locking position, the first pin 431 extends into both of the housing pin hole 41 and the tube through hole 42 so as to prevent the relative movement between the housing 2 and the core body 3, but is not limited to such.

Figure 5:
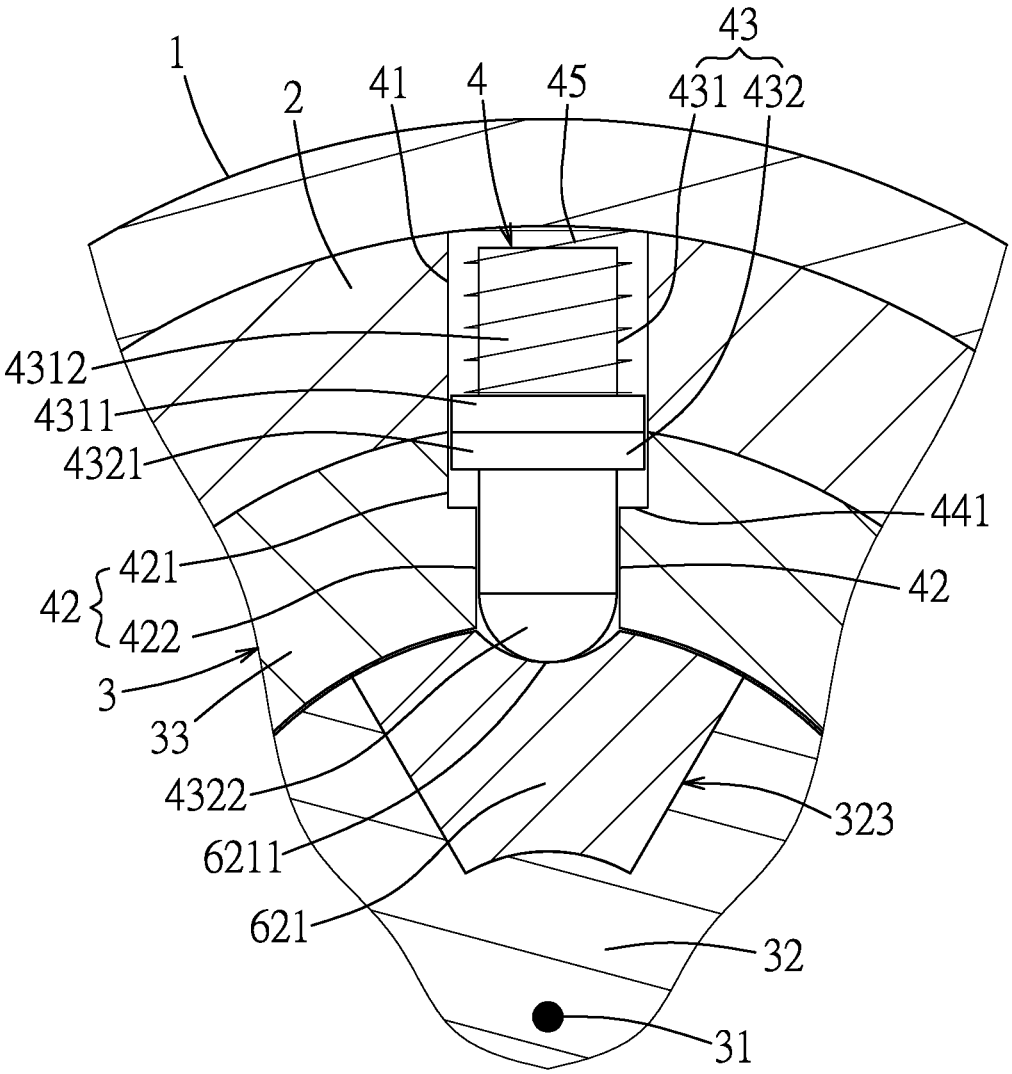
FIG. 5 is another fragmentary sectional view illustrating the pin assembly of the lock at an unlocking position.

Referring to FIG. 5, when the core body 3 is at the latching position relative to the housing 2 and when the helical blades 621 of the key 6 are respectively inserted into the helical keyways 323, the pin assembly 43 engages the recess 6211 of the corresponding helical blade 621 and is moved to the unlocking position so as to permit the relative movement between the housing 2 and the core body 3. In this embodiment, when the pin assembly 43 engages the recess 6211 of the corresponding helical blade 621, the first pin 431 is removed from the tube through hole 42 so as to permit the relative movement between the housing 2 and the core body 3, but is not limited to such.

Referring to FIG. 2, it should be noted that, when the core body 3 is moved relative to the housing 2 to an unlatching position where the housing pin hole 41 and the tube through hole 42 of the tumbler unit 4 are misaligned from each other, the retaining groove 22 of the housing 2 and the positioning groove 332 of the core tube 33 are aligned with each other, so that the positioning member 52 is biased by the compression spring 51 to hit a groove-defining surface of the core tube 33 that defines the positioning groove 332 to vibrate the key 6 for indicating that the core body 3 is moved to the unlatching position.

To pick the lock 100 of this disclosure, a person has to make a counterfeit key that has key blades respectively corresponding to the helical blades 621 of this disclosure in geometry and shape, such as cross-sectional area, thickness, inclined angle and extending direction, for being able to be inserted into the helical keyways 323, which is relatively difficult.

Figure 6:
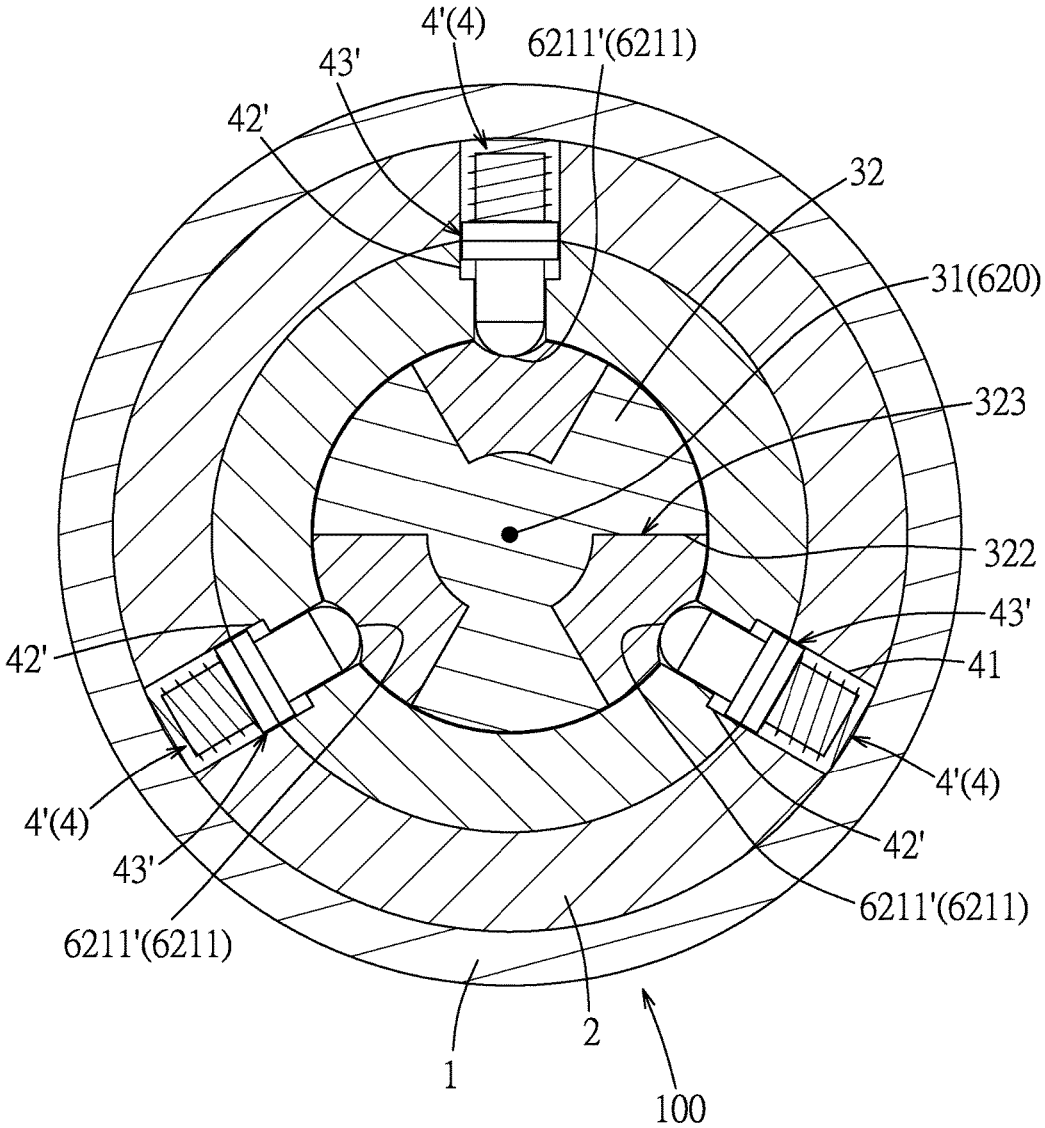
FIG. 6 is a sectional view illustrating a modification of the first embodiment.

Referring to FIG. 6, in a modification of the first embodiment, three of the tumbler units 4 that respectively correspond to the helical keyways 323 serve as three coplanar tumbler units 4'. All of the tube through holes 42' of the coplanar tumbler units 4' reside in a first plane that is perpendicular to the lock axis 31. The number of the coplanar tumbler units 4' is not limited to such, but must be the same as the number of the helical keyways 323. In addition, one of the recesses 6211 of each of the helical blades 621 serves as a coplanar recess 6211' (i.e., there are three coplanar recesses 6211'). All of the coplanar recesses 6211' of the helical blades 621 reside in a second plane that is perpendicular to the key axis 620. Since all of the tube through holes 42' of the coplanar tumbler units 4' reside in the first plane, when the key 6 is inserted into the lock 100, the first plane and the second plane must coincide with each other, so that the coplanar recesses 6211' of the helical blades 621 respectively correspond in position to the pin assemblies 43' of the coplanar tumbler units 4', and that each of the pin assemblies 43' engages the corresponding coplanar recess 6211' to be moved to the unlocking position. In other words, even if a person can make a counterfeit key that has key blades respectively corresponding to the helical blades 621 of this disclosure in geometry and shape, the position of each of the coplanar recess 6211' is difficult to be inspected. As such, even if the key blades of the counterfeit key are respectively inserted into the helical keyways 323, the pin assemblies 43' cannot be simultaneously moved to the unlocking position. Therefore, the difficulty in picking the lock 100 is further increased.

Referring to FIG. 6, in one embodiment, the coplanar tumbler units 4' or the helical keyways 323 are equiangularly spaced apart from each other (i.e., by 120 degrees), but are not limited to such. The number of the coplanar tumbler units 4' or the helical keyways 323 may be more than one, and is not limited to three.

Figure 7:
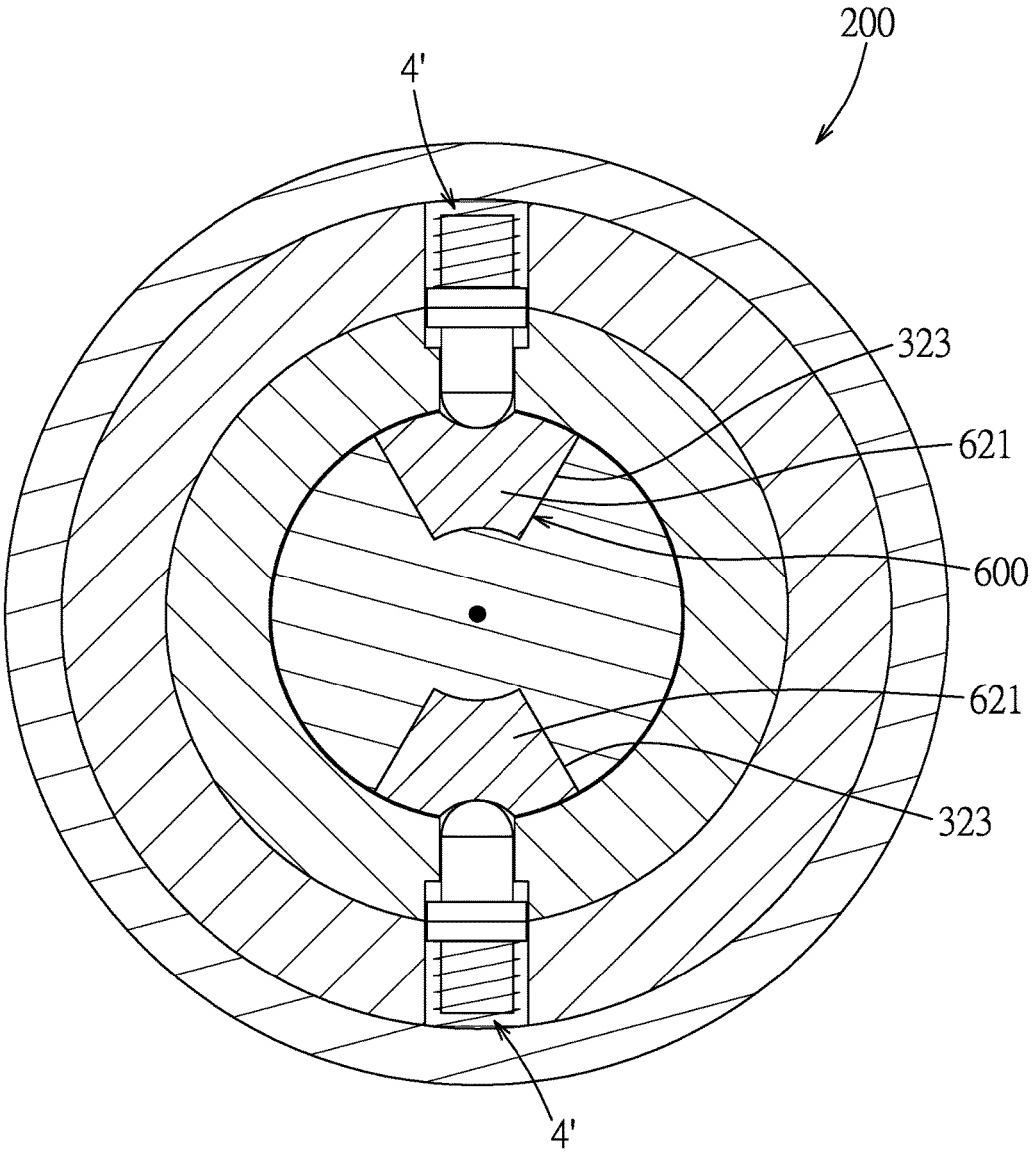
FIG. 7 is a sectional view illustrating a second embodiment of the lock device according to the disclosure.

Referring to FIG. 7, the lock 200 of the second embodiment of the lock device according to the disclosure has two helical keyways 323 and two coplanar tumbler units 4'. The coplanar tumbler units 4' or the helical keyways 323 are diametrically spaced apart from each other (i.e., by 180 degrees). Correspondingly, the key 600 of the second embodiment has two helical blades 621.

Figure 8:
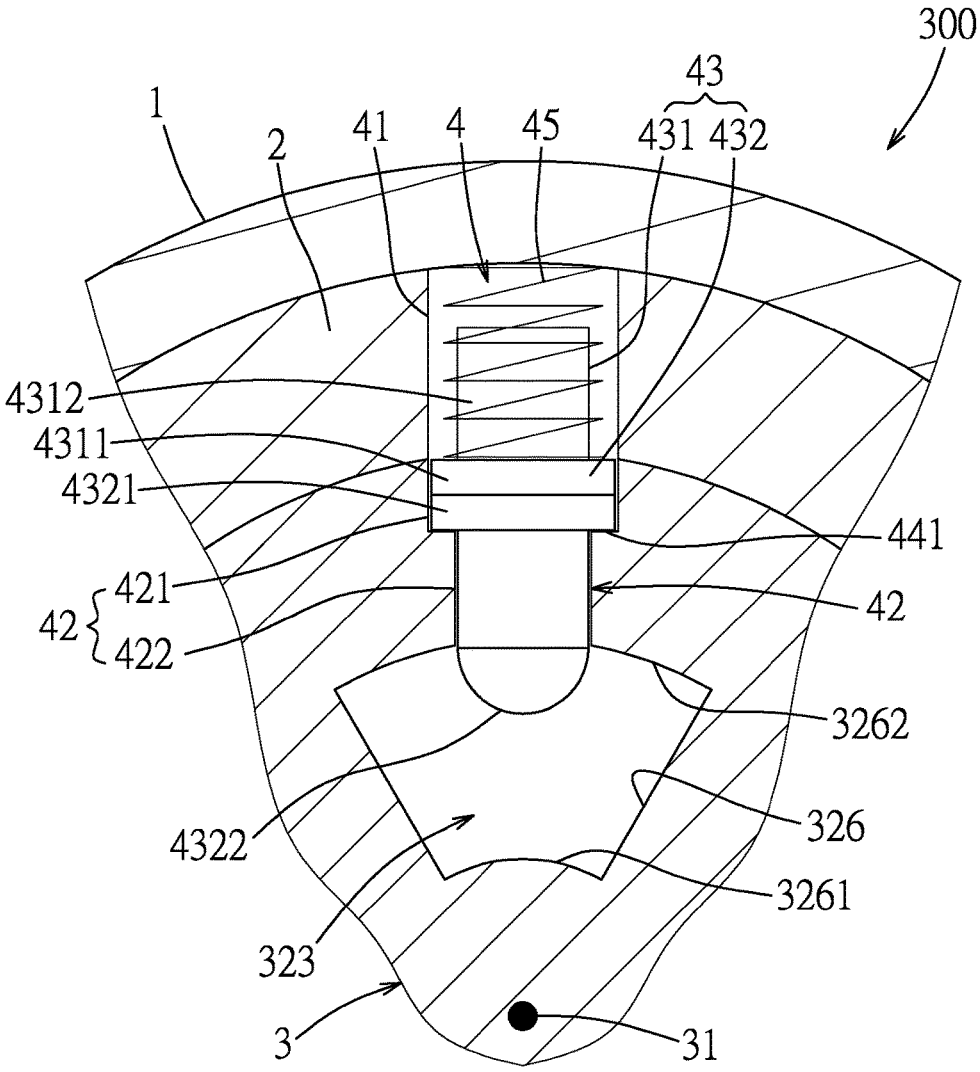
FIG. 8 is a fragmentary sectional view illustrating a third embodiment of the lock device according to the disclosure.

Referring to FIG. 8, in the third embodiment of the lock device according to the disclosure, the core body 3 of the lock 300 is monolithic (i.e., the core axle and the core tube are formed as one piece), and the helical keyways 323 (only one is shown) are formed within the core body 3. In other words, the monolithic core body 3 has a plurality of keyway-defining surfaces 326 that respectively define the helical keyways 323. Each of the keyway-defining surfaces 326 has a proximate surface portion 3261 that is proximate to the lock axis 31, and a distal surface portion 3262 that is distal from the lock axis 31 and that is spaced apart from the proximate surface portion 3261. The resilient member 45 of each of the tumbler units 4 resiliently biases the pin assembly 43 toward the proximate surface portion 3261 of the corresponding keyway-defining surface 326. When the core body 3 is at the latching position relative to the housing 2 and when the key (not shown) is not inserted into the lock 300, the pin assembly 43 of each of the tumbler units 4 partially extends into the corresponding helical keyway 323 through the distal surface portion 3262 of the corresponding keyway-defining surface 326.

In summary, compared with the conventional lock device, it is relatively easy to form the recess 6211 in the outer helical surface of each of the helical blades 621. Moreover, since the tube through hole 42 of each of the tumbler units 4 is configured not to extend through the lock axis 31 of the core body 3, the structural strength of the core body 3 is relatively high. In addition, a person cannot knock the lock 100, 200, 300 of this disclosure in a single direction for moving the pin assembly 43 of each of the tumbler units 4 to the unlocking position, so the difficulty in picking the lock 100, 200, 300 of this disclosure is increased.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A lock comprising:

a housing having an inner surrounding surface that defines an inner space;

a cylindrical core body having a lock axis, said core body being substantially mounted in said inner space, and being rotatable relative to said housing about the lock axis, said core body including a core axle that extends along the lock axis, and a core tube that is sleeved on said core axle, said core axle having at least one helical keyway that is formed in an outer surrounding surface thereof and that extends about the lock axis, said at least one helical keyway extending through an end surface of said core axle to form an insertion opening; and a plurality of tumbler units each including a housing pin hole that is formed in said inner surrounding surface of said housing, a tube through hole that is formed through said core tube and that is in spatial communication with said at least one helical keyway, a pin assembly that is movably mounted in said housing pin hole and said tube through hole, a hole-defining surface that defines said tube through hole, and a resilient member that is disposed in said housing and that resiliently biases said pin assembly toward the lock axis, said hole-defining surface having a shoulder surface portion that faces away from said core axle;

wherein, when said core body is at a latching position relative to said housing where said housing pin hole and said tube through hole of said at least one tumbler unit are aligned with each other, said resilient member resiliently biases said pin assembly to abut against said shoulder surface portion and extend into said at least one helical keyway through said inner surrounding surface of said housing, and wherein said core axle has a plurality of said helical keyways, some of said tumbler units serving as coplanar tumbler units that respectively correspond to said helical keyways and that reside in a first plane perpendicular to the lock axis.

2. The lock as claimed in claim 1, wherein said pin assembly includes a first pin that is movably mounted in said housing pin hole, and a second pin that is movably mounted in said tube through hole, said pin assembly being movable between a locking position and an unlocking position when said core body is at the latching position relative to said housing, when said pin assembly is at the locking position, said pin assembly preventing the relative movement between said housing and said core body, and said second pin abutting against said shoulder surface portion and extending into said at least one helical keyway, when said pin assembly is at the unlocking position, said pin assembly permitting the relative movement between said housing and said core body.

3. The lock as claimed in claim 2, further comprising a sleeve that is sleeved on said housing, said housing pin hole being formed through said housing, said first pin having a large-diameter section, and a small-diameter section that has a diameter smaller than that of said large-diameter section, said resilient member being configured as a compression spring that surrounds said small-diameter section of said first pin and that has two opposite ends respectively abutting against an inner surface of said sleeve and said large-diameter section of said first pin.

4. The lock as claimed in claim 1, wherein said core tube has a through hole that is formed through inner and outer surrounding surfaces thereof, said core axle further having a connecting hole that is formed in said outer surrounding surface thereof, said core body further including a connecting pin that is inserted into said through hole of said core tube and said connecting hole of said core axle so that said core axle and said core tube are co-rotatable with each other.

5. The lock as claimed in claim 1, wherein said core axle and said core tube of said core body are formed as one piece.

6. A key adapted to be used with the lock in claim 1, comprising:

a grip section for being held; and a blade section connected to said grip section, said blade section including at least one helical blade that extends about a key axis of said key, said at least one helical blade being adapted to correspond in shape to the helical keyway of the lock, and having at least one recess that is formed in an outer helical surface thereof, said recess of said at least one helical blade being adapted to be engaged with the pin assembly of the lock when said at least one helical blade is inserted into the helical keyway of the lock, wherein said blade section includes a plurality of helical blades, each of said helical blades being adapted to correspond in shape to a respective one of the helical keyways of the lock, and having at least one recess that is formed in an outer helical surface thereof, said at least one recess of each of said helical blades serving as a coplanar recess, said coplanar recesses of said helical blades residing in a second plane that is perpendicular to the key axis, said coplanar recesses of said helical blades being adapted to be respectively engaged with the pin assemblies of the coplanar tumbler units of the lock when said helical blades are respectively inserted into the helical keyways of the lock.

* * * * *